US006074499A

United States Patent [19]

Stone et al.

[11] Patent Number: 6,074,499

[45] Date of Patent: Jun. 13, 2000

[54] BORON-COPPER-MAGNESIUM-TIN ALLOY AND METHOD FOR MAKING SAME

[75] Inventors: Glen A. Stone; Stanley M. Howard, both of Rapid City, S. Dak.

[73] Assignee: South Dakoga School of Mines and Technology, Rapid City, S. Dak.

[21] Appl. No.: 09/004,728

[22] Filed: Jan. 9, 1998

[51] Int. Cl.[7] ..... C22C 9/02

[52] U.S. Cl. ..... 148/433; 420/470

[58] Field of Search ..... 420/470; 148/433

[56] References Cited

U.S. PATENT DOCUMENTS 4,732,731 3/1988 Asai et al. ..... 420/473

FOREIGN PATENT DOCUMENTS 08288450 11/1966 Japan .
01025929 1/1989 Japan .
02163331 6/1990 Japan .
69736 4/1981 Romania .

OTHER PUBLICATIONS

Kozo Osamura, et al., "Die Struktur der ausgeschiedenen Phase und das Ausscheidungsverhalten einer ternaren Kupfer–Zinn–Magnesium," Zeitschrift Fur Metallkunde v. 67, No. 7, Jul. 1976, pp. 467–472. English Title—"The Structure and Behavior of Precipitates in a Cu–Sn–Mg Ternary Alloy."

William B. Hampshire, "A Cu–Sn–Mg Alloy for Contact Applications," Metal Progress, Nov. 1973, p. 59.

Kazumasa Togano, et al., Effects of Magnesium Addition to the Cu–Sn Matrix in the Composite–Processed $Nb_3SN$ Superconductor, Journal of the Less–Common Metals, vol. 68, 1979, pp. 15 to 22.

E.E. Vicente et al., "The $Cu_2Mg$–$CuMg_2$–$Mg_2Sn$ Ternary Eutectic," Journal of Materials Science Letters, vol. 15, 1996, pp. 1690 to 1696.

Collection of ternary phase diagrams for the Cu–Mg–Sn system: *Handbook of Ternary Diagrams*, vol. 8, American Society for Metals, Metals Park, Ohio 44073, 1995, pp. 9694 to 9707.

P.M. Berge, et al., "A new high strength, high conductivity copper alloy wire," Wire Journal International, 1991.

J. Miyake, et al., "Design of High–Strength, High–Conductivity Alloys," MRS Bulletin, Jun. 1996, pp. 13 to 18.

G. Ghosh, et al., "The Systems–Based Design of High–Strength, High Conductivity Alloys," JOM, Mar. 1997, pp. 56 to 60.

Research Request—Alloy development—Jul. 8, 1996.

Glen A. Stone: "Development of High Strength and Conductivity Beryllium Free Castable Copper Alloys," Research Proprosal, Product Focus: Copper Alloy Spot Welder Robot Arms, Sep. 20, 1996, pp. 1–21.

*Primary Examiner*—Sikyin Ip
*Attorney, Agent, or Firm*—Nixon & Vanderhye P.C.

[57] ABSTRACT

A high strength, highly electrically conductive copper-based alloy and method for producing the alloy are provided, with the alloy containing boron in the range of 0.0–2.9 at. %, magnesium in a range of about 2.8–7.6 at. %, tin in a range of about 2.1–4.3 at. %, and the balance copper and unavoidable impurities. The method for producing the high-strength, highly conductive alloy includes solution heat treating or annealing the material to dissolve the solute elements into a solid solution including the copper, rapidly quenching the material to freeze the solute elements in solid solution, and aging the material at a temperature in a range of about 400–475° C. to precipitation harden the alloy material.

12 Claims, 7 Drawing Sheets

BORON-COPPER-MAGNESIUM-TIN ALLOY AND METHOD FOR MAKING SAME

BACKGROUND OF THE INVENTION

1. Field of the Invention

The present invention relates to copper alloys, and particularly to alloys of copper containing boron, magnesium and tin as the alloying elements, and to a method for producing these alloys.

2. Description of Related Art

Heretofore, copper alloys containing beryllium as the sole or principal alloying element, referred to generally herein as copper beryllium alloys, have been employed in applications requiring the properties of high strength and high electrical conductivity. Beryllium is alloyed with the copper principally as a precipitation hardening agent, so as to improve the mechanical properties, particularly to increase the tensile strength of the copper.

Beryllium compounds have been shown to cause disease, and beryllium is recognized as a carcinogen, therefore, the use of beryllium as an alloying agent is being phased out at foundries in the United States. This has created a need for other high strength, highly conductive alloys, preferably copper-based alloys, for use in applications which have, prior to this time, primarily employed copper beryllium alloys.

Precipitation hardenable copper alloys and processes for producing copper alloys having high strength and/or high electrcal conductivity have previously been proposed. An example is presented in U.S. Pat. No. 4,434,016, which is directed to a precipitation hardenable copper alloy that includes a substantial quantity of nickel, and further includes aluminum, manganese, magnesium, and restricts the amount of silicon to very small amounts. The processing of this alloy to produce precipitation hardening in the alloy involves a complex series of steps requiring mechanical deformation to be performed.

Other alloys proposed in the prior art include the alloy disclosed in U.S. Pat. No. 4,338,130, which, in specifically avoiding the use of beryllium, employs not only nickel and silicon, but also requires aluminum and chromium to be present as alloying elements. Chromium has further been proposed in several other disclosures as being an alloying element in a precipitation hardenable copper alloy, or as an alloying element in a copper alloy that improves the mechanical properties through mechanisms other than precipitation hardening, such as dispersion hardening. Many of the prior art hardenable copper alloys depend upon the use of one or more steps of mechanical deformation to cold work the material in order to increase the mechanical properties sought for the alloy, at the expense of decreasing the ductility or formability of the alloys.

As noted in the '130 patent, the use of magnesium has traditionally been avoided, in that magnesium tends reduce electrcal conductivity and rease ductility. Magnesium is present in the copper-based alloy of the '016 patent and its presence indeed is disclosed as being critical, but the '016 patent expressly states that magnesium is not to exceed 0.5 wt.%.

Another beryllium-free copper alloy that has been employed in high-strength, high conductivity applications is designated as C81540. This alloy is a sand castable chromium-nickel-copper alloy containing 0.4–0.8 wt.% silicon, 2.0–3.0 wt.% nickel, 0.1–0.6 wt.% chromium, with the remaining balance being mainly copper, however, the specification permits minor amounts of other elements in the alloy. This alloy achieves its strength through the reaction of chromium and silicon, or nickel and silicon, or both.

There continues to exist a need for alloys that have relatively low additions of alloying elements, and that can be produced or processed in a simple manner, preferably without the need to conduct mechanical deformation steps, wherein the finished product has high strength and high electrical conductivity.

It is therefore a principal object of the present invention to provide a copper-based alloy composition having high strength and high electrical conductivity, while avoiding the use of beryllium as a precipitation hardening agent.

It is a further principal object of the present invention to provide a copper-based alloy composition that is precipitation hardenable to provide increased hardness and tensile strength, without the need to mechanically deform the material in obtaining those properties.

It is an additional principal object of the present invention to provide a precipitation hardenable copper based alloy in which relatively small amounts of specific alloying elements are employed.

It is an additional important object of the present invention to provide a copper-based quaternary alloy in which boron, magnesium and tin are essentially the only alloying elements.

It is a further principal object of the present invention to provide a process for producing a precipitation hardened copper-based quaternary alloy that includes a solution heat treatment followed by rapid quenching and then age hardening.

It is an additional important object of the present invention to provide a process for producing a precipitation hardened copper-based quaternary alloy as set forth in the preceding paragraph, and which does not require any steps of mechanical deformation or cold working to achieve the desired strength-properties.

SUMMARY OF THE INVENTION

The above and other objects are achieved in the present invention by providing a copper-based quaternary alloy in which boron, magnesium and tin are included in the alloy a the three elements alloyed with the copper. More specifically, relatively small amounts of boron, magnesium and tin are added to copper in order to render the alloy precipitation hardenable in a simple process sequence involving solutionizing the alloy, rapidly quenching the alloy to freeze the solute elements (boron, magnesium and tin) in an unstable solid solution, and then aging the material to precipitate stable intermetallic compounds formed of copper, boron, magnesium, and tin.

The alloy composition of the quaternary alloy of the present invention includes a range of about 0.0–2.9 at. % boron, about 2.8–7.6 at. % magnesium, about 2.1–4.3 at. % tin, and the balance copper and possibly trace amounts of unavoidable impurities. A preferred range of compositions within the above composition range to obtain optimum electrical conductivity includes from about 0.5 at. % boron, about 4.8 at. % magnesium, about 3.3 at. % tin, with the balance being copper and unavoidable impurities. A preferred range of compositions within the above composition range to obtain optimum hardness (strength) includes from about 0.0 at. % boron, about 4.4 at. % magnesium, about 3.3 at. % tin, with the balance being copper and unavoidable impurities. Thunder where optimum strength is the paramount consideration, the alloy would essentially be a ternary alloy of copper, magnesium and tin.

The process for producing a high strength, high conductivity copper-based quaternary alloy having alloying additions of boron, magnesium and tin includes heating an alloy having a composition within the prescribed range to a temperature above about 680° C., and preferably to a temperature in the range of 680–700° C., to dissolve at least the majority of the boron, magnesium and tin in the copper, and then rapidly quenching the alloy from that temperature, as by ice water bath, to freeze these solute elements in an unstable solid solution with copper. The solutionizing heat treatment is generally carried out for 1–3 hours at temperature. The process further includes aging the thus-quenched alloy at a temperature in a range of about 350° C. to about 500° C. for a predetermined period of time, which will result in significant precipitation hardening, whereby intermetallic compounds of boron, copper, magnesium and tin will precipitate out of solid solution to harden and strengthen the alloy.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments taken in conjunction with the accompanying drawings wherein like reference characters represent like parts throughout the several views.

DETAILED DESCRIPTION OF THE PREFERRED EMBODIMENTS

Figure 1:
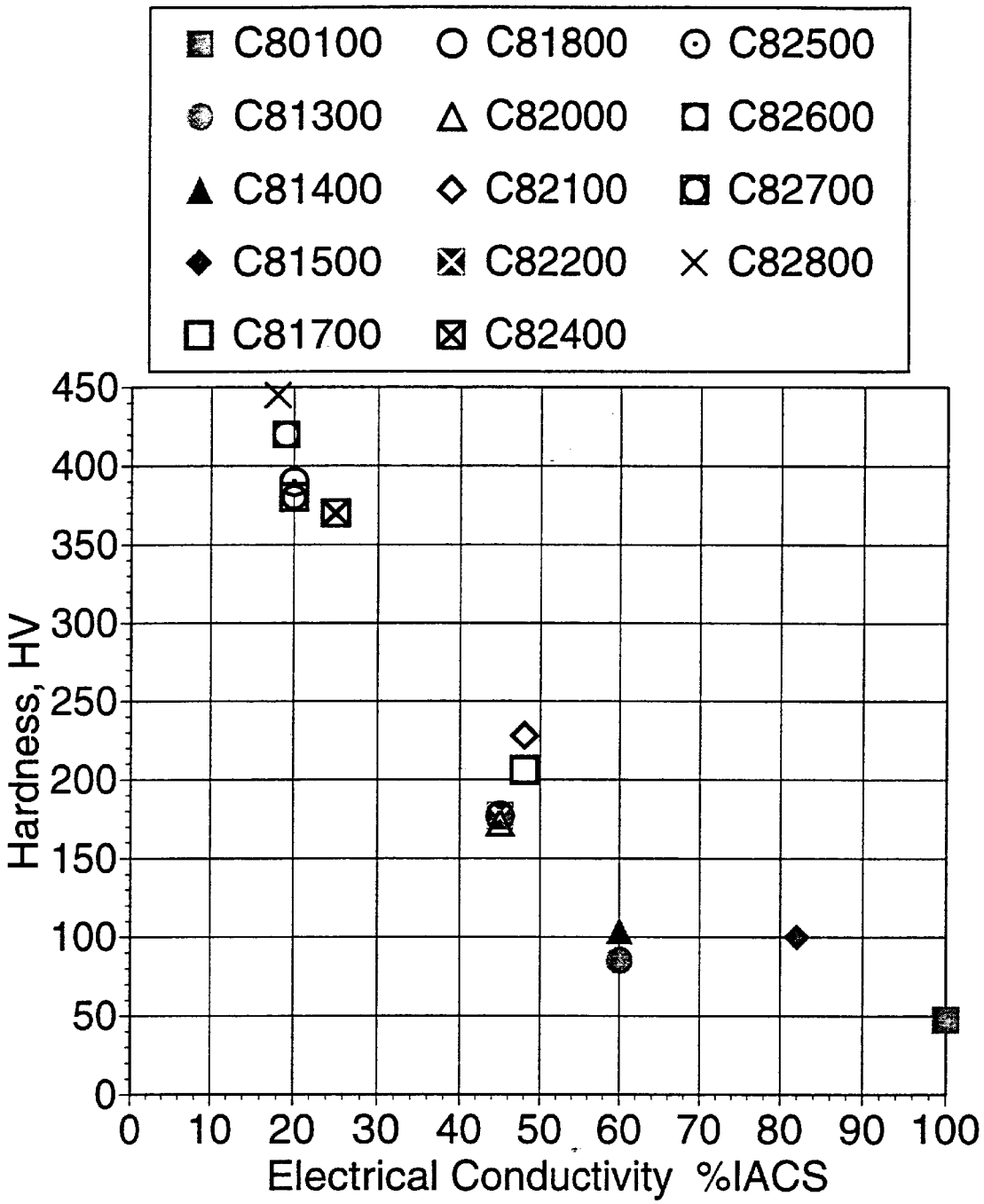
FIG. 1 is a chart illustrating the electrical conductivity and hardness properties of existing beryllium-containing copper alloys.

FIG. 1 presents electrical conductivity and corresponding hardness data for fourteen existing copper-based alloys that contain beryllium as a precipitation hardening agent. The data points were established using data published in *STANDARDS HANDBOOK, Cast Copper Alloys and Copper Alloy Products*, Part 7—Alloy Data, Revised 1978, Copper Development Association, Inc., New York, N.Y. The units of hardness used in FIG. 1 are HV (Hardness Vickers Scale), and the units of electrical conductivity are %IACS (International Association of Conductivity Standards).

In the course of identifying precipitation-hardening copper alloys for the purpose of replacing such copper beryllium high-strength, high electrical conductivity alloys, the B—Cu—Mg—Sn alloys of the present invention were developed. As used herein, the term "high strength" generally refers to copper alloys having hardnesses comparable to or exceeding values in FIG. 1 with corresponding electrical conductivity, as demonstrated by the alloys of the present invention. Also, for the purposes of the disclosure of the present invention, the term "high electrical conductivity" is used to refer to a copper alloys having electrical conductivity comparable to or exceeding values in FIG. 1 with corresponding hardness, as also demonstrated by the alloys of the present invention.

It is to be noted that the disclosure herein correlates hardness values with strength properties, with higher hardness values corresponding to higher strength alloys. The relationship between hardness and strength for beryllium copper alloys has been well established, and it will be readily apparent to those of skill in the art that a similar relationship between hardness and strength will exist for the beryllium-free copper alloys of the present invention. Thus, as used herein, the expression "hardness (strength)" is intended to indicate a direct measure of hardness, which thus provides an indirect measure or indication of the strength of the alloy.

It was determined by the present inventors that the solute elements employed in the alloy of the present invention, namely boron, magnesium and tin, would have reducing solubility in copper with decreasing temperatures, and that stable intermetallic compounds such as CuMgSn and $Cu_4MgSn$ can form in a copper-magnesium-tin ternary alloy. The presence of boron in the B—Cu—Mg—Sn quaternary alloy aids in the reduction of total solute in copper, thus improving the electrical conductivity of the alloy.

The use of magnesium has traditionally been avoided, or is present in only very small amounts, in copper alloys that have been proposed for end uses in which good electrical conductivity is desired. This is evidenced in U.S. Pat. No. 4,388,130, which, as previously discussed, discloses that even small amounts of magnesium will significantly reduce conductivity. U.S. Pat. No. 4,434,016 discloses that the use of a very minor amount of magnesium, asserted to otherwise be a critical alloying element for the alloy disclosed therein, was not seen to reduce the electrical conductivity of that alloy. That patent, while recognizing that further enhancement of a property referred to as stress relaxation might be obtained with further increases in magnesium content, nevertheless discloses that the magnesium content should not exceed 0.5% by weight (1.3 at. %), so as to avoid inferior strength-to-bend properties.

In the present invention, the alloy contains a significantly greater amount of magnesium, preferably in a range of about 2.8–7.6 at. % while still achieving high electrical conductivity. Tin is also present in the copper-based alloy in a preferred range of about 2.1–4.3 at. %. Boron is added to enhance electrical conductivity in the preferred range of about 0.0–2.9 at. %, and the balance is preferably copper and possibly trace amounts of unavoidable impurities.

Within this overall preferred composition, an especially preferred composition of solute elements that enhances electrical conductivity is about 0.5 at. % boron, 4.8 at. % magnesium, 3.3 at. % tin, and the balance is copper and possibly trace amounts of unavoidable impurities. The preferred composition that enhances hardness (strength) is about 0.0 at. % boron, 4.4 at. % magnesium, 3.3 at. % tin, and the balance is copper and possibly trace amounts of unavoidable impurities. These alloys are expected to demonstrate superior strength and/or electrical conductivity properties, when produced in accordance with the process of the present invention.

High strength, high conductivity copper alloys will generally attain their desired strength properties through precipitation hardening, also referred to as age hardening, or by dispersion hardening or cold working, or both. The quaternary alloy of the present invention is a precipitation hardenable alloy. A preferred process for producing this alloy includes the steps of giving the alloy a solution heat treatment, quenching the alloy at a sufficiently fast rate to freeze the majority of the solute elements, boron, magnesium and tin, in a solid solution with copper, and then heating the thus-quenched alloy to a temperature sufficient to precipitate out the intermetallic compounds formed with the solute elements.

More specifically, the alloy is preferably subjected to an annealing or solutionizing heat treatment at or above 680° C., and preferably in the range of about 680° C. to 700° C. The annealing is conducted for a length of time sufficient to bring all or the majority of the boron, magnesium and tin into solution with the copper. An appropriate duration may preferably be three (3) hours. The subsequent quenching of the alloy material is preferably a rapid quench, for example, by quenching in ice water. The aging or precipitation hardening step is preferably conducted at a temperature in the range of about 350 to 500° C.

Figure 2:
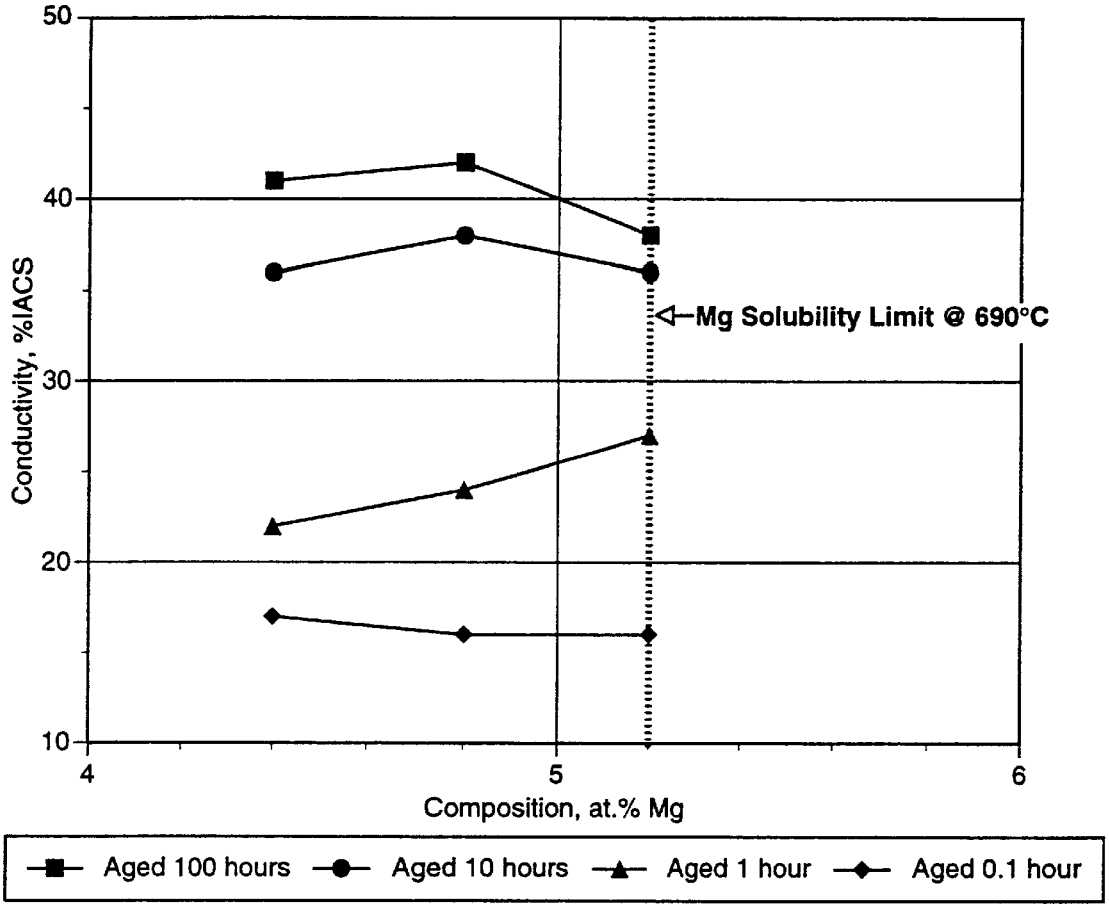
FIG. 2 is a graph illustrating changes in electrical conductivity as a function of heat treatment for copper-based quaternary alloys containing varying amounts of magnesium therein.

The achievement of high electrical conductivity in as-cast parts, followed by solutionizing then aging is important to the nonferrous foundry industry. FIG. 2 is a graph which plots the electrical conductivity as a function of magnesium concentration and aging time. Boron and tin are held constant at 0.5 at. % and 3.3 at. % respectively. The balance is copper and unavoidable impurities. The highest electrical conductivity is achieved when the magnesium composition is 4.8 at. %. A preferred alloy for high electrical conductivity is 0.5 at. % boron, 4.8 at. % magnesium, and 3.3 at. % tin, balance copper and unavoidable impurities. Other tests on alloys of similar composition have demonstrated that the high levels of electrical conductivity are attainable with magnesium contents up to about 5.2 at. %. The rate that electrical conductivity increases as a function of aging time at an aging temperature of 400° C. is evident in FIG. 2. The processing history prior to age hardening includes a solution heat treatment or anneal at 690° C. for three hours, followed by a quench in ice water.

Figure 3:
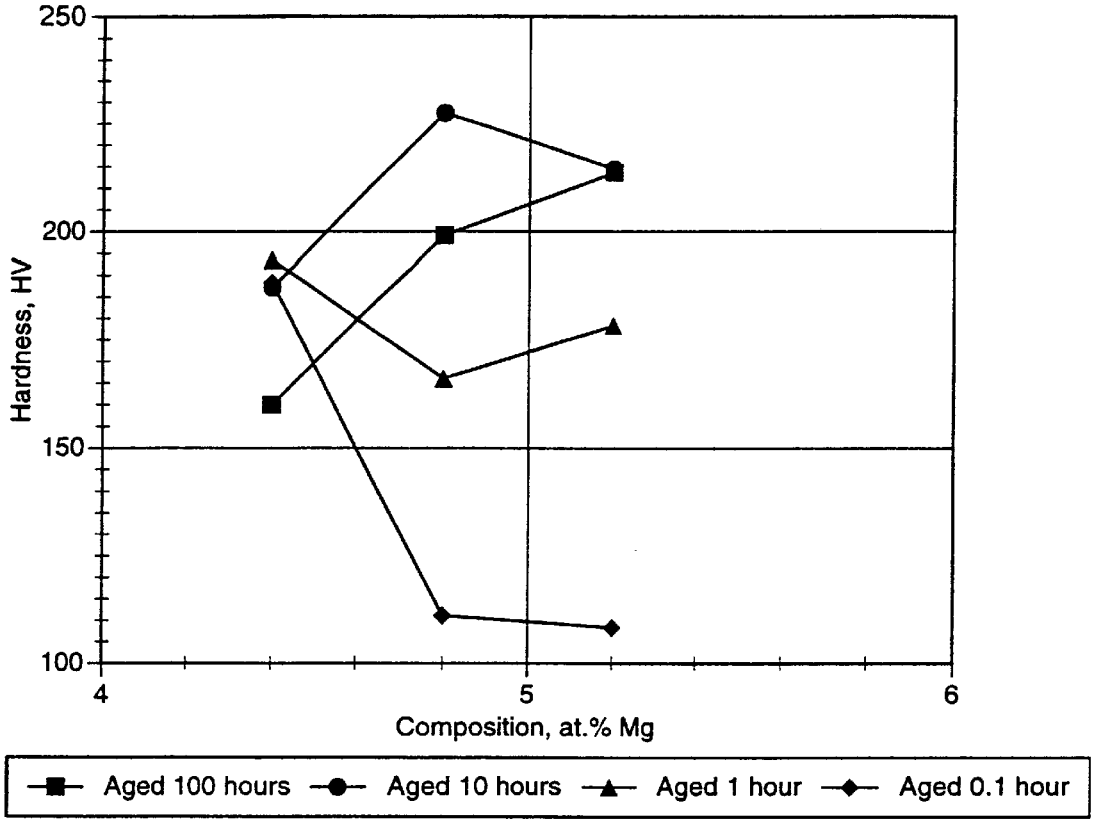
FIG. 3 is a graph illustrating changes in hardness (strength) as a function of heat treatment for copper-based quaternary alloys having varying amounts of magnesium therein.

FIG. 3 is a graph which plots the hardness (strength) as a function of magnesium concentration and aging time for the same alloys in FIG. 2. Boron and tin are held constant at 0.5 at. % and 3.3 at. % respectively. The balance is copper and unavoidable impurities. The highest hardness (strength) is achieved when the magnesium composition is 4.8 at. %. A preferred alloy for high hardness (strength) is 0.5 at. % boron, 4.8 at. % magnesium, and 3.3 at. % tin, balance copper and unavoidable impurities. The hardening behavior as a function of aging time at an aging temperature of 400° C. is evident in FIG. 3. Note that the aging time for the highest hardness (strength) is 10 hours whereas in FIG. 2 the highest electrical conductivity is achieved after aging 100 hours. The processing history prior to age hardening includes a solution heat treatment or anneal at 690° C. for three hours, followed by a quench in ice water.

Figure 4:
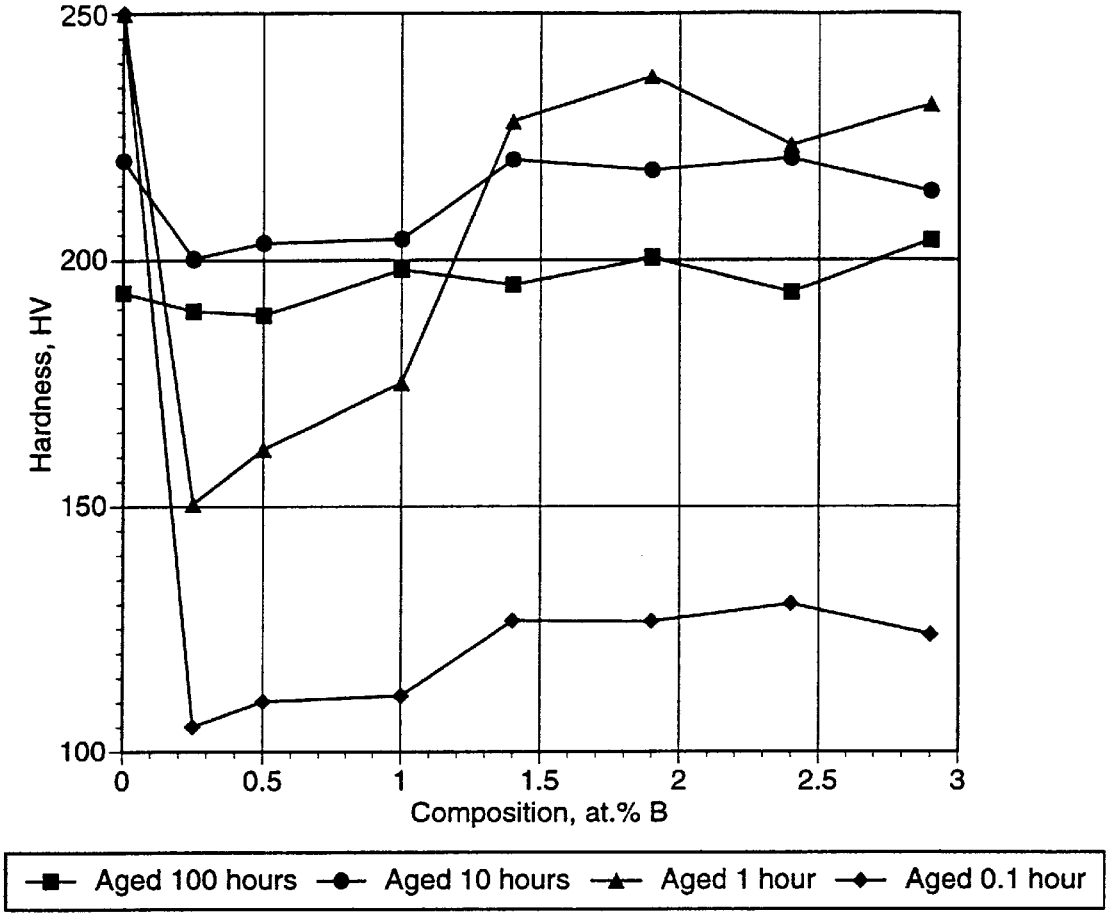
FIG. 4 is a graph illustrating changes in hardness (strength) as a function of heat treatment for copper-based quaternary alloys having varying amounts of boron therein.

Very high hardness (strength) and good electrical conductivity are attainable in the alloys of the present invention. FIG. 4 is a graph of hardness (strength) as a function of varying amounts of boron. The age hardening in FIG. 4 is conducted at 400° C., for the various noted times.

The magnesium composition in the alloys used in obtaining the data present in FIG. 4 is 4.4 at. %, and tin is present at 3.3 at. %, and the balance is copper and unavoidable impurities. A preferred alloy when high hardness (strength) is desired is 0.0 at. % boron, 4.4 at. %; magnesium and 3.3 at. % tin. A hardness of HV 250 is achievable after aging for one hour at 400° C. with that alloy composition. The processing history prior to age hardening includes a solution heat treatment or anneal at 696° C. for three hours, followed by a quench in ice water.

Figure 5:
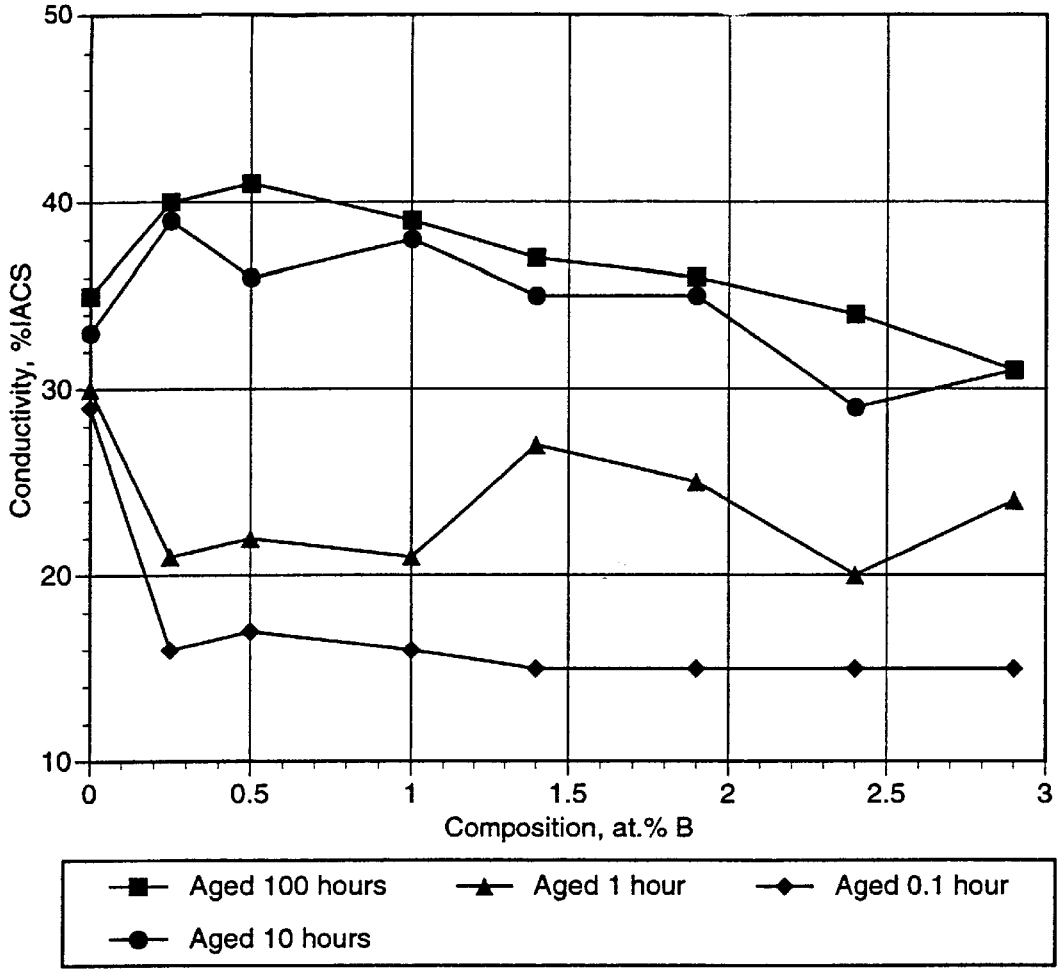
FIG. 5 is a graph illustrating changes in electrical conductivity as a function of heat treatment for copper-based quaternary alloys having varying amounts of boron therein.

FIG. 5 is a graph of the electrical conductivity as a function of varying amounts of boron for the same alloys reported in FIG. 4. The composition of element magnesium is 4.4 at. % and element tin is 3.3 at. %, the balance being copper and unavoidable impurities. These data have the same thermal processing history and chemical compositions as those presented in FIG. 4.

It can thus be seen that high electrical conductivity can be attained in such alloy compositions, particularly with increased aging time. Also, in viewing both FIGS. 4 and 5 together, it can be seen that the elimination of boron from the alloy can yield increased hardness (strength) properties, while the addition of relatively small amounts of boron will increase the electrical conductivity, with some possible sacrifice of hardness (strength) in the resulting alloy. It will be readily apparent to persons skilled in the art, upon reading this disclosure, that the alloy composition of these alloys can be modified within the ranges disclosed in order to achieve desired conductivity/strength combinations.

Figure 6:
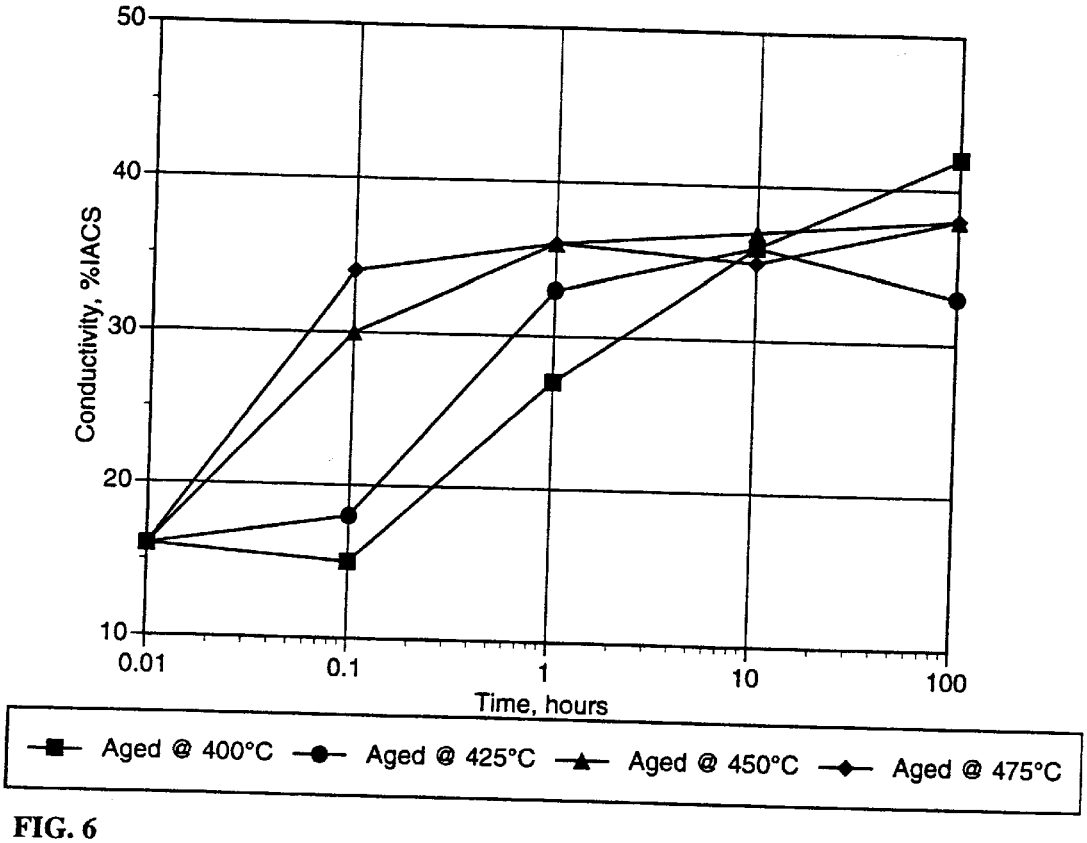
FIG. 6 is a graph illustrating the aging temperature response of a preferred high electrical-conductivity alloy, showing electrical conductivity graphed as a function of aging time for various aging temperatures.
Figure 7:
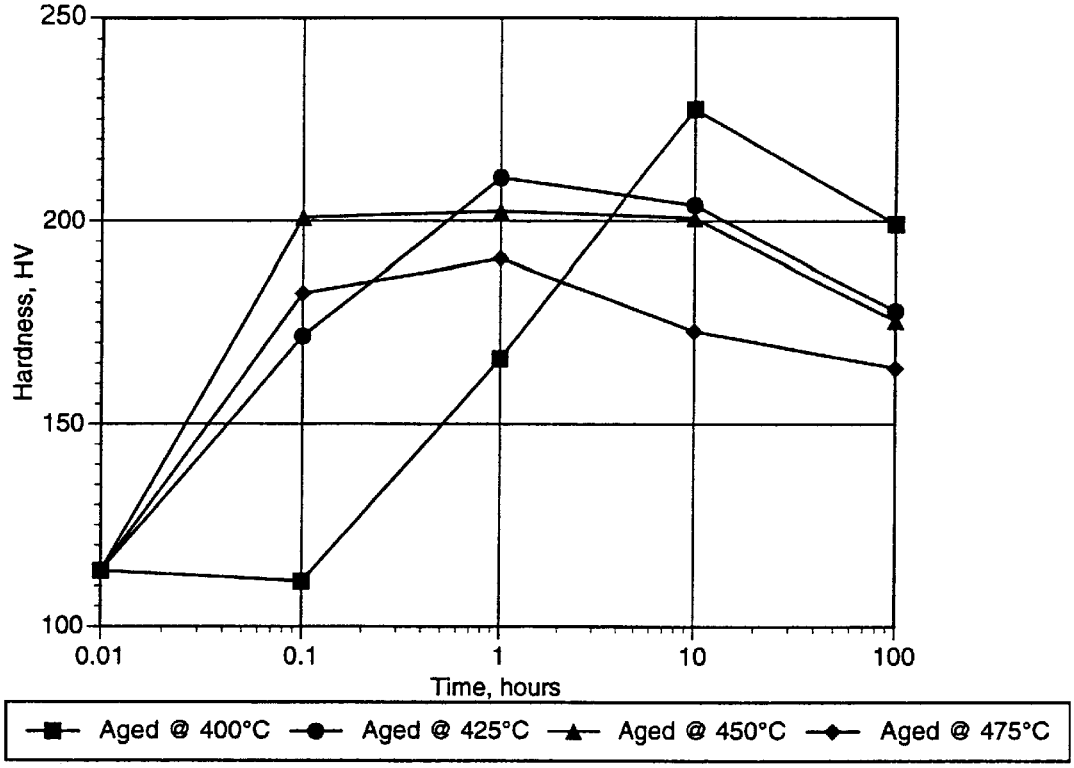
FIG. 7 is a graph illustrating the aging temperature response of the preferred high electrical conductivity alloy, showing hardness (strength) graphed as a function of aging time for various aging temperatures.

Selection of the aging temperature can cause significant changes in the properties of the alloy. FIGS. 6 and 7 provide aging data at 400° C., 425° C., 450° C. and 475° C., for the preferred alloy composition: 0.5 at. % boron, 4.8 at. % magnesium, 3.3 at. % tin, balance copper with unavoidable impurities. The kinetics of the precipitation process are generally unacceptably slow at temperatures below 400° C. FIG. 6 shows that, at 400° C., an achievable electrical conductivity is 42% IACS after aging for 100 hours. At 450° C. and 475° C. an achievable electrical conductivity is 36% IACS after aging for one hour.

FIG. 7 shows that, at 400° C., an achievable hardness (strength) is HV 227 after aging for 10 hours. At 450° C. and 475° C., achievable hardnesses (strengths) after aging for one hour are HV 210 and HV 202, respectively.

The process of the present invention thus preferably entails a solutionizing heat treatment and rapid quench, and subsequently aging the alloy at an aging temperature equal to or in excess of 400° C., for example, 450° C., and further entails aging the as-quenched alloy for a time preferably not exceeding one-hundred (100) hours, and, even more preferably, not exceeding about ten (10) hours. It is believed that aging temperatures in excess of 500° C. will not yield hardnesses of above 200 HV, and therefore are not likely to be of any substantial commercial importance. The solutionizing heat treatment is preferably conducted at a temperature in a range of about 680–700° C., for a time ranging from 1–3 hours.

Alloys having compositions within the ranges disclosed herein, and processed in accordance with the method described above, have high strength and are highly electrically conductive. Accordingly, the alloys are promising candidates to be used in applications in which copper beryllium alloys have heretofore been used.

It is to be understood that the foregoing description of the preferred embodiments of the present invention is for illustrative purposes only, and variations and modifications may become apparent to those of ordinary skill in the art upon reading this disclosure and viewing the figures forming a part of this disclosure. Such variations and modifications do not depart from the spirit and scope of the present invention, and the scope of the invention is to be determined by reference to the appended claims.

What is claimed is:

1. A quaternary alloy consisting of:

up to about 2.9 at. % boron;

about 2.8 to about 7.6 at. % magnesium;

about 2.1 to about 4.3 at. % tin; and the balance being copper and unavoidable impurities.

2. A quaternary alloy as recited in claim 1, consisting of:

about 0.5 at. % boron;

about 4.2 to about 5.2 at. % magnesium;

about 3.3 at. % tin; and the balance being copper and unavoidable impurities.

3. A copper-based quaternary alloy as recited in claim 2, wherein the alloy has an electrical conductivity of about 40% IACS or above.

4. A copper-based quaternary alloy as recited in claim 2, wherein the alloy has a Vickers hardness of about 225 HV or above.

5. A copper-based quaternary alloy as recited in claim 4, wherein the alloy has an electrical conductivity of about 40% IACS or above.

6. A quaternary alloy as recited in claim 1, consisting of:

up to about 2.9 at. % boron;

about 4.4 at. % magnesium;

about 3.3 at. % tin; and the balance being copper and-unavoidable impurities.

7. A copper-based quaternary alloy as recited in claim 6, wherein the alloy has an electrical conductivity of 40% IACS or above.

8. A copper-based quaternary alloy as recited in claim 6, wherein the alloy has a Vickers hardness of about 250 HV.

9. A copper-based quaternary alloy as recited in claim 6, wherein the alloy has an electrical conductivity of 40% IACS or above.

10. A quaternary alloy as recited in claim 1, consisting of:

about 0.5 at. % boron;

about 4.6 at. % magnesium;

about 3.3 at. % tin; and the balance being copper and unavoidable impurities.

11. A copper-based quaternary alloy as recited in claim 10, wherein the alloy has an electrical conductivity of about 35% IACS or above.

12. A copper-based quaternary alloy as recited in claim 10, wherein the alloy has a Vickers hardness of about 200 HV or higher.

* * * * *